US006454353B1

(12) United States Patent
Knaus

(10) Patent No.: US 6,454,353 B1
(45) Date of Patent: Sep. 24, 2002

(54) CHAIR, IN PARTICULAR WORK CHAIR

(75) Inventor: Oskar Knaus, Messstetten (DE)

(73) Assignee: Interstuhl Bueromoebel GmbH & Co. KG, Messstetten (DE)

( * ) Notice: Subject to any disclaimer, the term of this patent is extended or adjusted under 35 U.S.C. 154(b) by 0 days.

(21) Appl. No.: 09/790,752

(22) Filed: Feb. 22, 2001

(51) Int. Cl.[7] ..... A47C 7/14

(52) U.S. Cl. ..... 297/284.11; 297/68; 297/84; 297/423.19; 297/423.28; 297/423.36

(58) Field of Search ..... 297/284.11, 423.19, 297/423.26, 423.28, 423.34, 423.36

(56) References Cited

U.S. PATENT DOCUMENTS

| | | | | |
|---|---|---|---|---|
| 156,004 A | * | 10/1874 | Wayland | 297/423.36 X |
| 4,678,229 A | * | 7/1987 | Ryan et al. | 297/68 |
| 5,246,266 A | * | 9/1993 | Ostergaard | 297/84 |
| 5,782,535 A | * | 7/1998 | Lafer | 297/423.36 |

FOREIGN PATENT DOCUMENTS

| | | |
|---|---|---|
| DE | 30 27 807 A | 2/1982 |
| DE | 41 04 697 A | 8/1992 |
| DE | 42 27 329 A1 | 2/1994 |
| DE | 43 39 114 A | 5/1995 |
| DE | 195 31 354 A | 3/1996 |
| DE | 196 54 432 A | 8/1998 |
| DE | 198 43 550 A1 | 3/2000 |
| WO | 97 22282 A | 6/1997 |

* cited by examiner

*Primary Examiner*—Rodney B. White
(74) *Attorney, Agent, or Firm*—Michael J. Striker

(57) ABSTRACT

A chair has a seat shell, a cushion having a front edge which extends outwardly beyond a front edge of the seat shell, a shaft arranged under a seat surface, an actuating element connected with the shaft and also connected with the front edge of the cushion, at least one first toothed disc arranged on the shaft, an endless element guided on the toothed disc and connected with the seat shell, a second toothed disc which together with the first toothed disc is displaceable parallel to the seat shell, so that by raising or lowering of the actuating element the front edge of the cushion is displaceable forwardly or rearwardly.

10 Claims, 4 Drawing Sheets

CHAIR, IN PARTICULAR WORK CHAIR

BACKGROUND OF THE INVENTION

The present invention relates generally to a chair, in particular a work chair, which has a seat shell provided with a cushion, wherein the front edge of the cushion extends outwardly beyond the front edge of the seat shell.

Persons must sit on work chairs over a long time. Since the long seats are not convenient for long time sitting, it is for example important when the seat support ergonomically supports the thighs. In other words, the seat surface must be dimensioned as to its depth so that it supports the thighs over its whole length, but does not press in the knee hollow when the pelvis abuts against the back rest. Since the chairs as a rule are made in accordance with predetermined standards, it is possible that for persons whose thighs lengths do not correspond to the standards can sit on the chair with less comfort. Moreover, frequently a chair is used by several persons of different body sizes, for example during layer exchange. Standard chairs are not identically convenient for sitting of all users. In order to eliminate these problems, chairs, in particular work chairs are equipped with a seat depth adjustment. Seats with a seat depth adjustment have preferably a telescopic extension formed so that moving the extension in or out provides a corresponding individual adjustment of the supporting surface for the thighs. A full surface support of the cushion and thereby of the thighs is however possible in this construction only with very high expenses.

SUMMARY OF THE INVENTION

Accordingly, it is an object of the present invention to provide a chair of the above mentioned general type, which with a simple construction, provides a seat depth adjustment which is also easy to operate.

In keeping with these objects and with others which will become apparent hereinafter, one feature of present invention resides, briefly stated, in a chair, in which the front edge of the cushion is mounted on an actuating element which is connected with a shaft arranged under the seat surface, and at least one toothed disc is arranged on the shaft over which an endless belt or an endless chain is guided, the belt or the chain are fixedly connected with the seat shell and a second toothed disc which is displaceable together with the first toothed disc parallel to the seat shell is guided so that, by raising or pressing down of the actuating element, the front edge of the cushion is displaceable forwardly or rearwardly.

When the chair is designed in accordance with the present invention, then a seat depth adjustment is implemented in a simple structural way and simultaneously can be easily operated by the user.

Preferably, the shaft with the at least one first toothed disc and with the at least one second tooth disc is arranged on a common component, which is displaceable relative to the seat shell and is supported on it.

The component can be for example a web with a front edge which supports the shaft with the first toothed disc, and with a rear edge which supports the second toothed disc.

The web can be mounted on a bushing which is guided on a rod connected with the seat shell. This provides for a simple construction.

The endless toothed belt or the endless chain can be arrestable by deviating rollers. Thereby a person who sits on the chair can not displace inadvertently with the legs the supporting surface for the thighs.

For the same purpose or when desired as an additional feature, the rod and the bushing can be arrestable with one another by the endless toothed belt or the endless chain arrestable by the deviating rollers.

For an improved guidance of the seat depth adjustment, correspondingly left and right from the center of the seat shell, two first toothed discs can be arranged on the shaft. An endless toothed belt or an endless chain can be guided in this manner.

The shaft can be formed as a hexagonal edge shaft, and a hexagonal opening can be provided on the toothed discs mounted on it. Thereby the force transmission from the actuating element to the toothed discs is ensured in a reliable manner by a form-locking connection.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
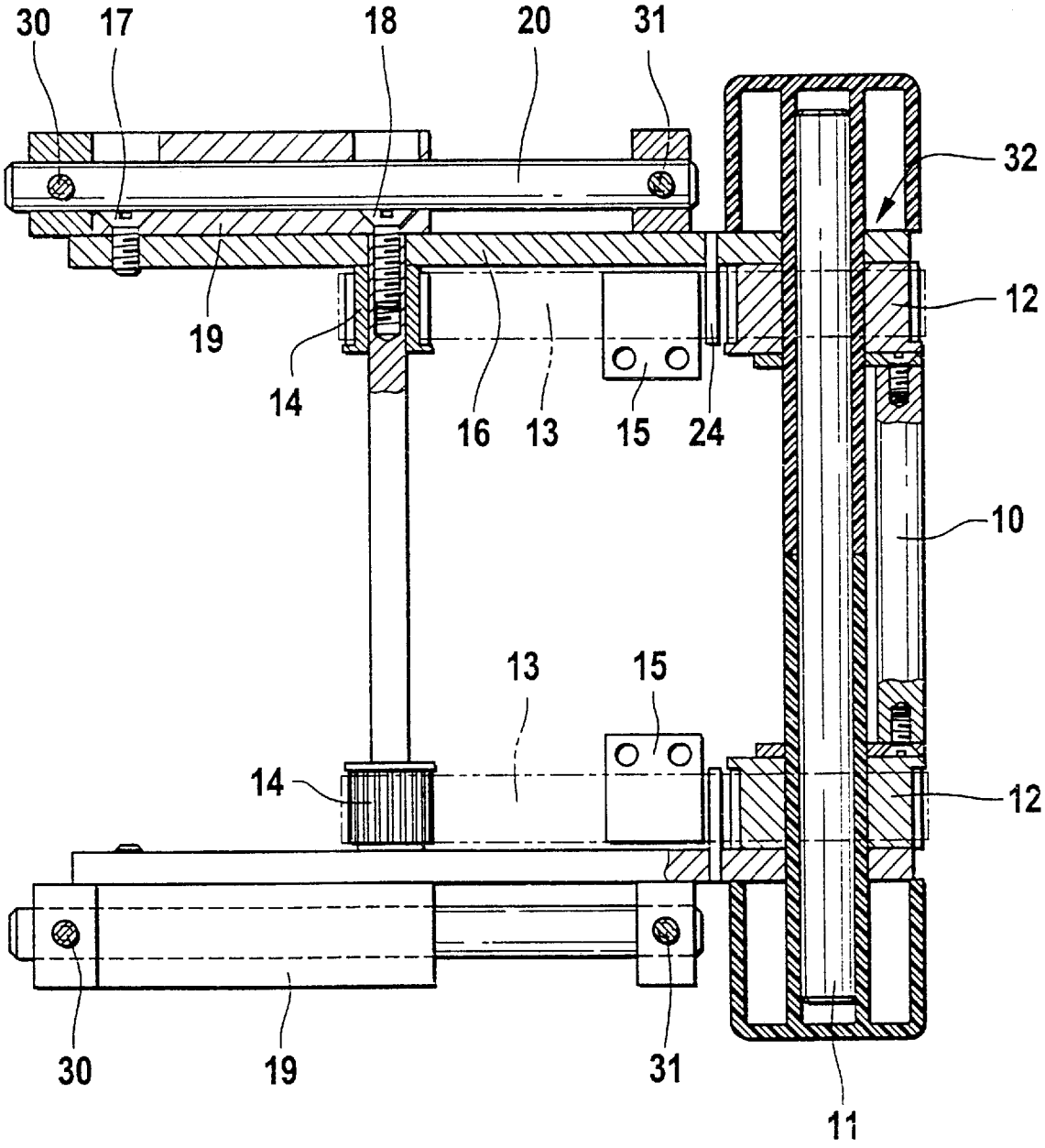
FIG. 1 is a partially sectioned plan view of a seat depth adjusting device of a chair in accordance with the present invention.

An actuarting element 10 of a chair in accordance with the present invention is shown in FIG. 1 and formed as a rib. It is connected with a shaft 11 in a way which is not described in detail. Two first toothed discs 12 are mounted on the shaft 11. They are connected with a second tooth disc 14 by endless tooth belts 13. Endless tooth belts 13 are firmly connected by a mounting element 15 with a seat plate 21 shown in FIG. 2. The second tooth disc 14 as well as the shaft 11 with the first tooth discs 12 are connected each with a web 16. The web 16 for this purpose is provided with an opening 32, for receiving the shaft 11. The web 16 is screwed on a bushing 19 by screws 17 and 18. The bushings 19 are displaceably guided on rods 20.

FIG. 2 shows a seat plate 21 of a work chair, which is provided with a cushion 22. It can be seen that the web 16 is arranged at the lower side of the seat plate 21, and one of the second toothed discs 14 and the shaft 11 are supported on the web 16. Deviating rollers 24 arrest the endless toothed belt 13 which is guided over the toothed discs 12 and 14. Thereby a person who fits on the chair can not inadvertently displace rearwardly the front edge 23 of the cushion 22 with its thighs. The rod-shaped actuating element 10 is mounted on the shaft 11. It is also connected with the front edge 23 of the cushion 22.

Figure 2A:
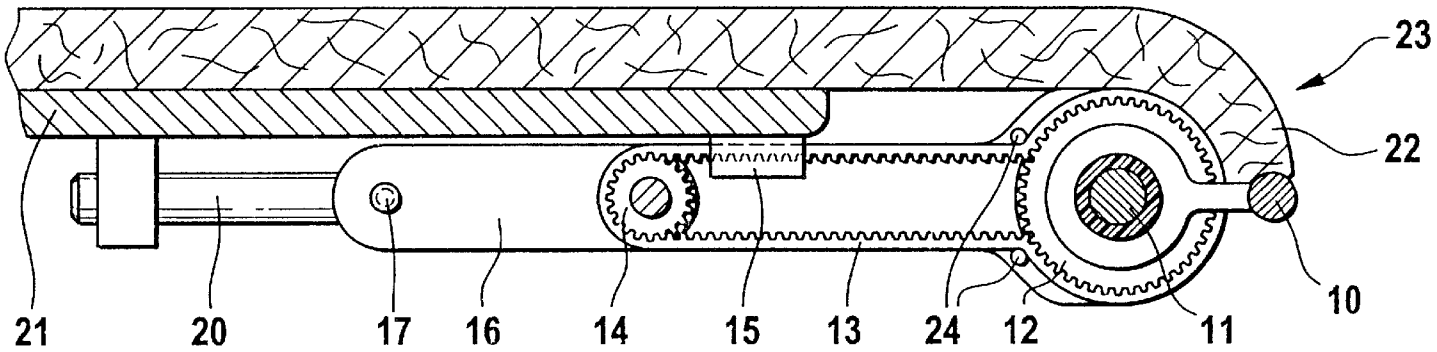
FIG. 2*a* and 2*b* are views showing a central longitudinal section through a seat surface of a chair with a seat adjustment device of FIG. 1, with two different seat depths.

FIG. 2*a* shows the actuating element 10 in its position which is turned forwardly and upwardly to a maximum. Thereby a maximum seat depth for the chair can be adjusted.

Figure 2B:
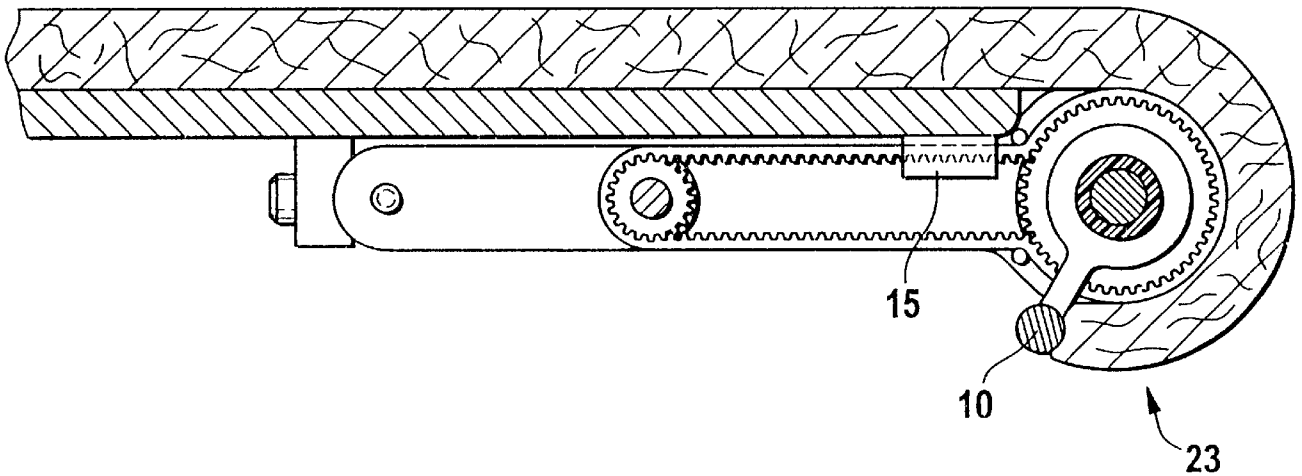

FIG. 2*b* shows the front edge 23 of the cushion 22 which is rolled rearwardly and downwardly by turning of the actuating element 10. Thereby a smaller seat depth than in FIG. 2a is provided.

When the actuating element 10 is turned, the shaft 10 and the toothed disc 12 mounted on it are also turned together with the actuating element. Since the endless toothed belts 13 are fixed by clamping elements 15 on the seat plate 21, the turning of the toothed discs 12 leads to a displacement of the web 16 on the rods 20. Because of this and because of the rolling of the cushion front edge 23 in and out, the sitting depth can be adjusted steplessly in accordance with the corresponding requirements of the user of the chair.

Figure 3:
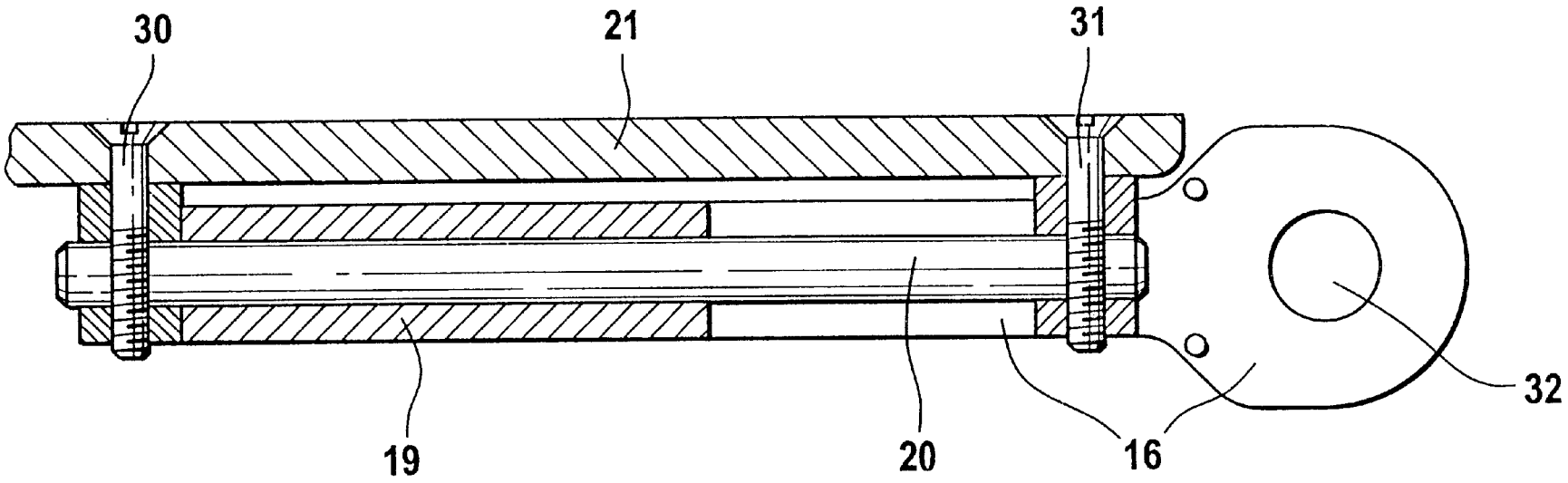
FIG. 3 is a partially sectioned part-side view of the seat adjusting device of FIG. 1.
Figure 4:
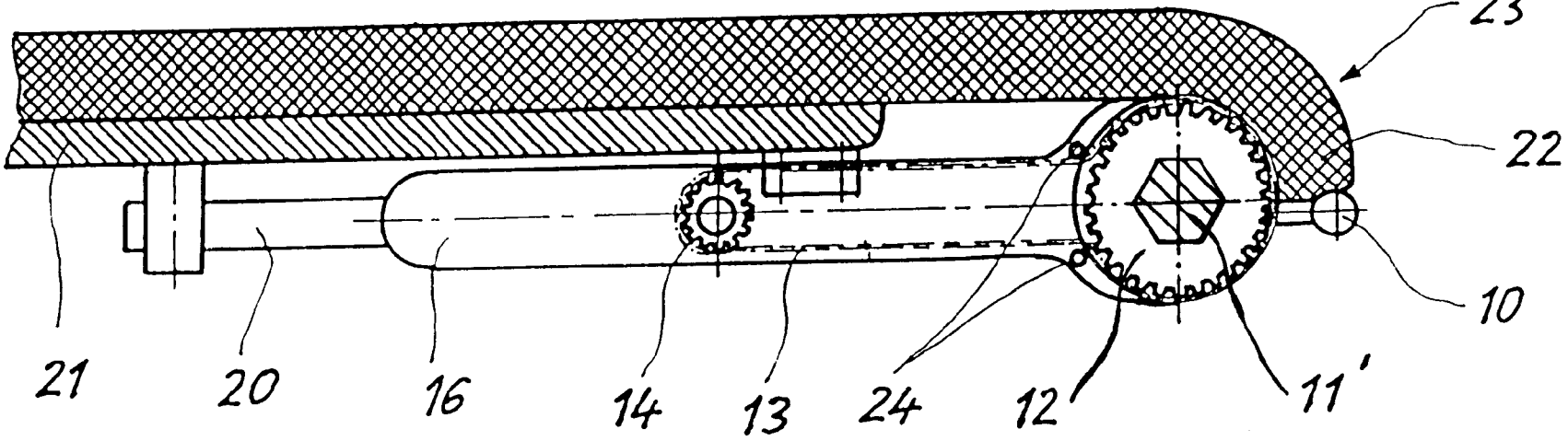
FIG. 4 shows a central longitudinal section through a seat surface of a chair with a second embodiment of the seat adjustment device where the shaft is formed as a hexagonal shaft 11 and the toothed discs mounted on the shaft having a corresponding hexagonal opening.

FIG. 3 shows a detailed view of the seat plate 21. The rod 20 is mounted by screws 30 and 31 on the seat plate 21. The web 16 is connected with the bushing 19 in a way shown in FIG. 1. The bushing 19 is displaceable on the rod 20 in the longitudinal direction of the rod 20. Thereby also the web 16, which in its front region has an opening 33 for receiving the shaft 11, can be displaced in a longitudinal direction of the rod 20.

It will be understood that each of the elements described above, or two or more together, may also find a useful application in other types of constructions differing from the types described above.

While the invention has been illustrated and described as embodied in chair, in particular work chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A chair, comprising a seat plate; a cushion having a front edge which extends outwardly beyond a front edge of said seat plate; a shaft arranged under a seat surface; an actuating element connected with said shaft and also connected with said front edge of said cushion; at least one first toothed disc arranged on said shaft; an endless element guided on said toothed disc and connected with said seat plate; a second toothed disc which together with said first toothed disc is displaceable parallel to said seat plate, so that by raising or lowering of said actuating element said front edge of said cushion is displaceable forwardly or rearwardly.

2. A chair as defined in claim 1, wherein two said first toothed discs are arranged on said shaft at a left side and at a right side from a center of said seat plate, said endless element being guided over said two first toothed discs.

3. A chair as defined in claim 1, wherein said shaft is formed as a hexagonal shaft, said toothed discs mounted on said shaft having a corresponding hexagonal opening.

4. A chair as defined in claim 1, wherein said endless element is an endless toothed belt.

5. A chair as defined in claim 1, wherein said endless element is an endless chain.

6. A chair, comprising a seat plate; a cushion having a front edge which extends outwardly beyond a front edge of said seat plate; a shaft arranged under a seat surface; an actuating element connected with said shaft and also connected with said front edge of said cushion; at least one first toothed disc arranged on said shaft; an endless element guided on said toothed disc and connected with said seat plate; a second toothed disc which together with said first toothed disc is displaceable parallel to said seat plate, so that by raising or lowering of said actuating element said front edge of said cushion is displaceable forwardly or rearwardly; and a connecting element on which said shaft with said at least one first toothed disc and said second toothed disc are arranged, said connecting element being supported displaceably on said seat plate relative to said seat plate.

7. A chair, comprising a seat plate; a cushion having a front edge which extends outwardly beyond a front edge of said seat plate; a shaft arranged under a seat surface; an actuating element connected with said shaft and also connected with said front edge of said cushion; at least one first toothed disc arranged on said shaft; an endless element guided on said toothed disc and connected with said seat plates a second toothed disc which together with said first toothed disc is displaceable parallel to said seat plate, so that by raising or lowering of said actuating element said front edge of said cushion is displaceable forwardly or rearwardly; and a connecting element on which said shaft with said at least one first toothed disc and said second toothed disc are arranged, said connecting element being supported displaceably on said seat plate relative to said seat plate, wherein said connecting element is a strap having a front end supporting said shaft with said at least one first toothed disc and a rear end supporting said second toothed disc.

8. A chair, comprising a seat plate; a cushion having a front edge which extends outwardly beyond a front edge of said seat plate; a shaft arranged under a seat surface; an actuating element connected with said shaft and also connected with said front edge of said cushion; at least one first toothed disc arranged on said shaft; an endless element guided on said toothed disc and connected with said seat plate; a second toothed disc which together with said first toothed disc is displaceable parallel to said seat plate, so that by raising or lowering of said actuating eleient said front edge of said cushion is displaceable forwardly or rearwardly; a connecting element on which said shaft with said at least one first toothed disc and said second toothed disc are arranged, said connecting element being supported displaceably on said seat plate relative to said seat plate, wherein said connecting element is a strap having a front end supporting said shaft with said at least one first toothed disc and a rear end supporting said second toothed disc; and a rod connected with said seat plate and a bushing which is guided on said rod, said strap being mounted on said bushing.

9. A chair, comprising a seat plate; a cushion having a front edge which extends outwardly beyond a front edge of said seat plate; a shaft arranged under a seat surface; an actuating element connected with said shaft and also connected with said front edge of said cushion; at least one first toothed disc arranged on said shaft; an endless element guided on said toothed disc and connected with said seat plate; a second toothed disc which together with said first toothed disc is displaceable parallel to said seat plate, so that by raising or lowering of said actuating element said front edge of said cushion is displaceable forwardly or rearwardly; a connecting element on which said shaft with said at least one first toothed disc and said second toothed disc are arranged, said connecting element being supported displaceably on said seat plate relative to said seat plate, wherein said connecting element is a strap having a front end supporting said shaft with said at least one first toothed disc and a rear end supporting said second toothed disc: and a rod connected with said seat plate and a bushing which is guided on said rod, said strap being mounted on said bushing, wherein said rod and said bushing are arrestable with one another.

10. A chair, comprising a seat plate; a cushion having a front edge which extends outwardly beyond a front edge of said seat plate; a shaft arranged under a seat surface; an actuating element connected with said shaft and also connected with said front edge of said cushion; at least one first toothed disc arranged on said shaft; an endless element guided on said toothed disc and connected with said seat plate; a second toothed disc which together with said first toothed disc is displaceable parallel to said seat plate, so that by raising or lowering of said actuating element said front edge of said cushion is displaceable forwardly or rearwardly; and deviating rollers which arrest said endless element on said at least one first toothed disc and said second toothed disc, thereby preventing an occupant of said chair from inadvertently displacing the front edge of the cushion.

* * * * *